US005509826A

United States Patent [19]

White

[11] Patent Number: 5,509,826

[45] Date of Patent: Apr. 23, 1996

[54] VERY LOW PROFILE CARD EDGE CONNECTOR

[75] Inventor: Robert C. White, Cliffside Park, N.J.

[73] Assignee: Burndy Corporation, Norwalk, Conn.

[21] Appl. No.: 142,172

[22] Filed: Oct. 22, 1993

[51] Int. Cl.[6] ..... H01R 23/70

[52] U.S. Cl. ..... 439/637; 439/64

[58] Field of Search ..... 439/630–637, 439/326–328, 59, 62, 65, 64

[56] References Cited

U.S. PATENT DOCUMENTS

| | | | |
|---|---|---|---|
| 3,199,066 | 8/1965 | Elidge et al. | 439/636 |
| 3,665,375 | 5/1972 | Thoms et al. | 339/192 R |
| 3,740,698 | 6/1973 | Jerominek | 439/631 |
| 4,293,179 | 10/1981 | Vonder | 439/637 |
| 4,487,468 | 12/1984 | Fedder et al. | 339/75 MP |
| 4,713,013 | 12/1987 | Regnier et al. | 439/328 |
| 4,826,447 | 5/1989 | Forker et al. | 439/328 |
| 4,846,734 | 7/1989 | Lytle | 439/637 |
| 4,934,961 | 6/1990 | Piorunneck et al. | 439/637 |
| 5,002,498 | 3/1991 | Takahashi | 439/328 |
| 5,052,936 | 10/1991 | Biechler et al. | 439/60 |
| 5,387,115 | 2/1995 | Kozel et al. | 439/328 |
| 5,407,365 | 4/1995 | Lin | 439/329 |

OTHER PUBLICATIONS

The Connector Selector, Master Catalog, vol. II, Burndy Corporation, pp. 10–8:10–12 and 10–17:10–22, 1986.

AMP Corporation Catalog 82834, "Dual Read–Out SIMM Sockets", pp. 1–4, Feb. 1993.

*Primary Examiner*—David L. Pirlot

*Attorney, Agent, or Firm*—Perman & Green

[57] ABSTRACT

A card edge connector is provided with a housing and electrical contacts. The housing has a card edge receiving area, end supports located at opposite ends of the card edge receiving area, and stability outriggers. The end supports extend up from a top surface of the housing and each has a slot for receiving a portion of a printed circuit board. The outriggers extend outward from lateral sides of the housing at the bottom of the housing. The outriggers also function as standoffs for the housing.

17 Claims, 2 Drawing Sheets

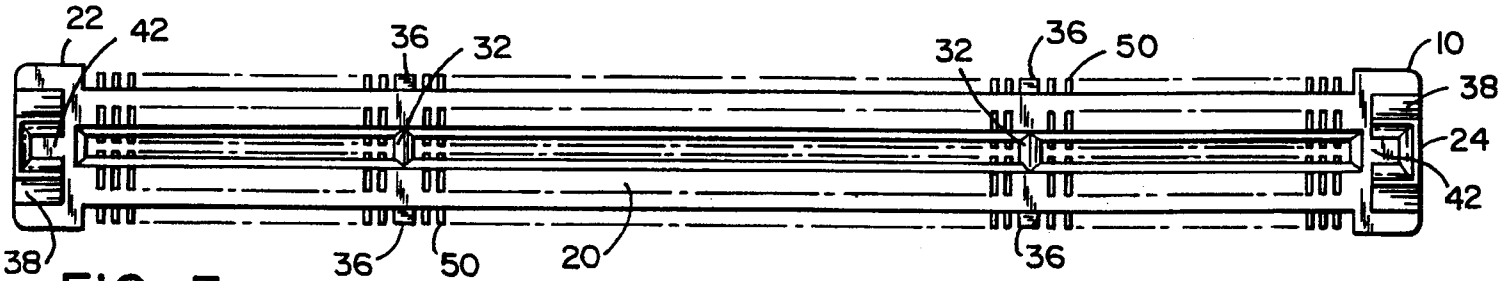
FIG. 3
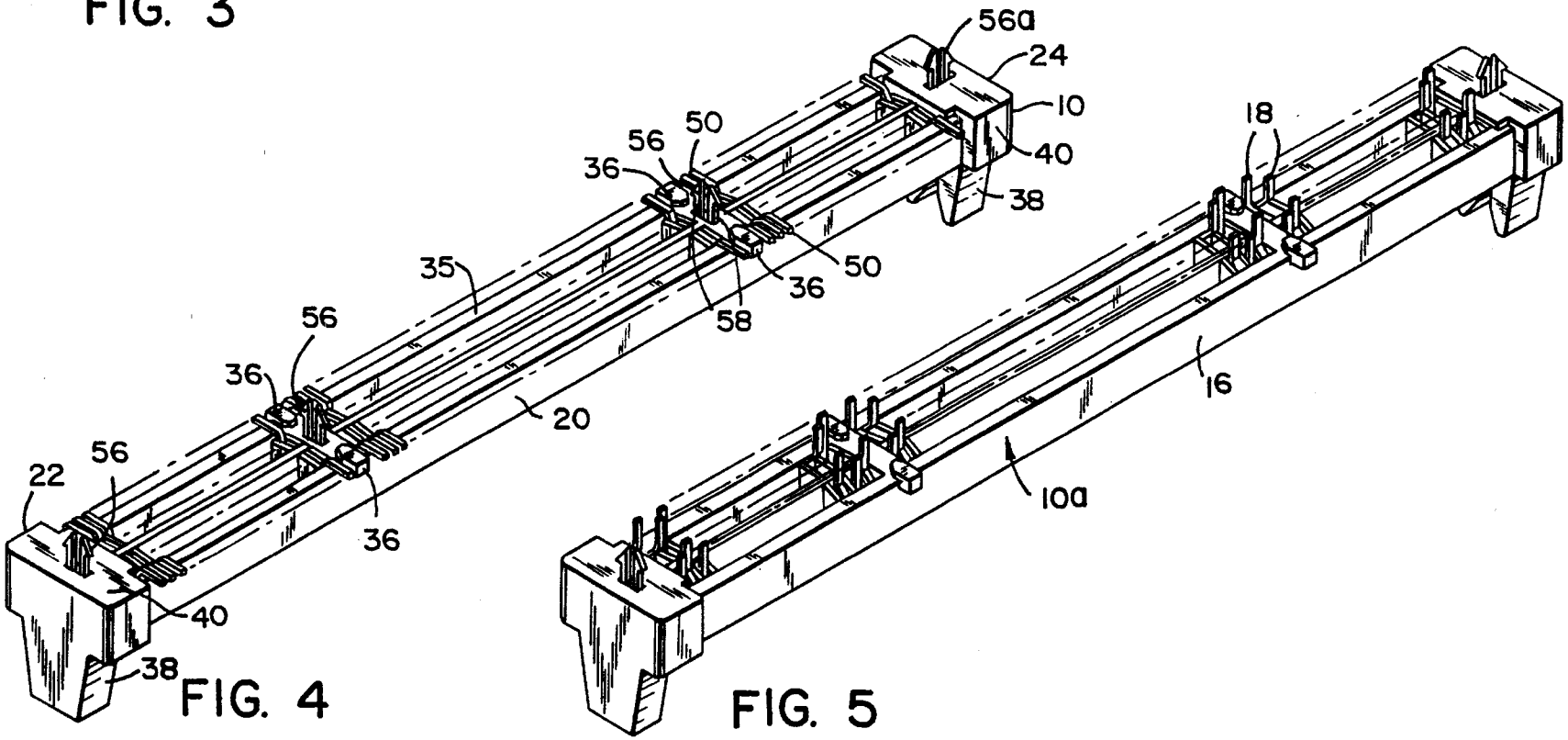
FIG. 4
FIG. 5

VERY LOW PROFILE CARD EDGE CONNECTOR

BACKGROUND OF THE INVENTION

1. Field of the Invention

The present invention relates to electrical connectors and, more particularly, to a card edge connector.

2. Prior Art

The art is replete with different types and kinds of card edge connectors. U.S. Pat. Nos. 4,846,734 and 4,934,961 show two different types of card edge connectors. U.S. Pat. No. 5,052,936 shows a card edge connector with contacts having surface mount solder tails and the housing having standoffs. U.S. Pat. 4,487,468 shows a card edge connector with guide rails at opposite ends of the connector. U.S. Pat. 3,665,375 discloses guides with slots to orientate a daughter board relative to a connection block. Burndy Corporation has manufactured card edge connectors with standoffs at both ends and extending outwardly from the housing to stably mount the connector on a mother board.

SUMMARY OF THE INVENTION

In accordance with one embodiment of the present invention, a card edge connector is provided comprising a housing and electrical contacts. The housing has a card edge receiving area, end supports located at opposite ends of the card receiving area, and outriggers. The end supports each have a slot for receiving a portion of a printed circuit board and extending up from a top surface of the housing. The outriggers extend outwardly from lateral sides of the housing at a bottom of the housing. The electrical contacts are mounted to the housing. In accordance with another embodiment of the present invention, a card edge connector is provided comprising a housing and electrical contacts. The housing is comprised of a one-piece molded dielectric material having a center section and end sections located on opposite ends of the center section. The center section has a card edge receiving area and outriggers extending laterally outward from longitudinal sides of the center section at a bottom of the housing. The end sections also have outriggers extending laterally outward from the end sections. The electrical contacts are mounted to the housing.

In accordance with another embodiment of the present invention, a card edge connector and printed circuit board assembly is provided comprising a mother printed circuit board, a card edge connector, and a daughter printed circuit board. The card edge connector is connected to the mother board and has a housing with a plurality of spring contacts. The housing has a center section with a card edge receiving area and two end sections with upwardly extending card end supports. The center section is substantially shorter in height than the end sections and the end supports have card receiving slots. The daughter board has a card edge connection area with contact pads on two sides located in the card edge receiving area and end edges located in and structurally supported by the card receiving slots of the end supports. The height of the center section is relatively short, but the end sections assist in stably connecting the daughter board to the connector.

BRIEF DESCRIPTION OF THE DRAWINGS

The foregoing aspects and other features of the invention are explained in the following description, taken in connection with the accompanying drawings, wherein:

FIG. 3 is a plan top view of the card edge connector shown in FIG. 1;

FIG. 4 is a perspective view of the bottom of the connector shown in FIG. 1; and FIG. 5 is a perspective view of a bottom of an alternate embodiment of the connector shown in FIG. 4.

DETAILED DESCRIPTION OF THE INVENTION

Figure 1:
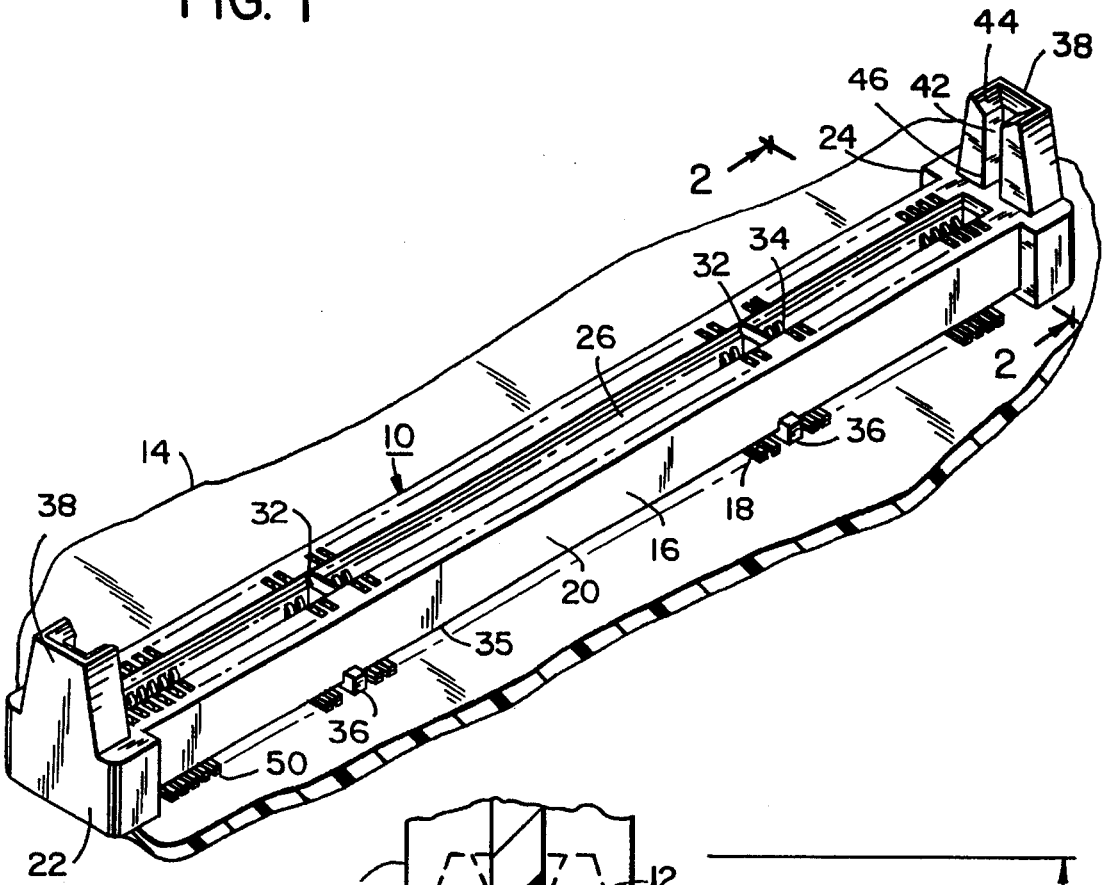
FIG. 1 is a perspective view of a card edge connector incorporating features of the present invention connected to a mother printed circuit board.
Figure 2:
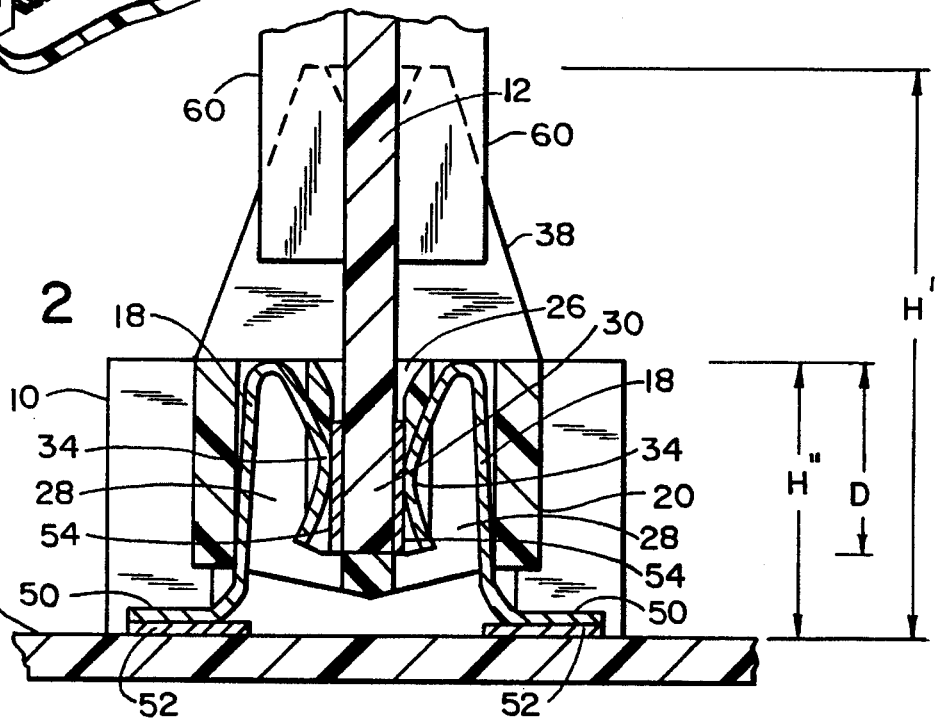
FIG. 2 is a cross sectional view of the connector and mother board shown in FIG. 1 taken along line 1—1 with a connected daughter printed circuit board.

Referring to FIGS. 1–4 there is shown a card edge electrical connector 10 for connecting a daughter printed circuit board 12 to a mother printed circuit board 14. Although the present invention will be described with reference to the embodiments shown in the drawings, it should be understood that features of the present invention can be embodied in various different forms of embodiments. In addition, any suitable size, shape or type of elements or materials could be used.

The connector 10 generally comprises a housing 16 and a plurality of electrical contacts 18. The housing 16 is comprised of a one-piece molded dielectric polymer or plastic material. The housing 16 includes an elongate center section 20 and two end sections 22, 24. The center section 20 has a card receiving area 26 and contact channels 28. The card receiving area 26 is suitably sized and shaped to receive the card edge connection area 30 of the daughter board 12 therein. Polarizing ridges 32 are provided in the receiving area 26 to prevent misconnection of the daughter board 12 as is generally known in the card edge connector technology. The depth D of the receiving area 26, in the embodiment shown, is preferably about 0.175 inch. However, other depths could be provided. The height H' of the end sections 22,24 is about 0.61 inch and the height H" of the housing is about 0.22 inch. The contact channels 28 are located on opposite sides of the receiving area 26 as two parallel rows with windows that open into the receiving area 26. The electrical contacts 18 are mounted in the contact channels 28 with contact areas 34 that extend through the windows into the receiving area 26. Located at the bottom of the center section 20 are standoff outriggers 36. The standoff outriggers 36 extend down from and laterally outward from the bottom 35 of the sides of the center section 20. The standoff outriggers 36 generally perform two functions. First, they function as standoffs to space the rest of the center section from the top surface of the mother board 14. Second, because they extend laterally outward from the sides of the center section 20, they function a stability outriggers to stably seat the center section 20 on the top surface of the mother board 14.

The end sections 22, 24 generally comprise end supports 38 and standoff outrigger bottoms 40. Each end support 38 has a slot 42 for receiving a portion of the daughter board 12. Each slot 42 has an open top end 44, an open inner side 46 that faces the other slot, and the remaining bottom end and sides are enclosed. The bottoms 40 extend downward further than the bottom 35 of the center section 20 the same distance as the standoff outriggers 36. Likewise, the bottoms 40 extend laterally outward from the end sections 22, 24 the same distance as the standoff outriggers 36.

The electrical contacts 18, in the embodiment shown, are generally comprised of spring contacts. First ends 50 are soldered to contact pads 52 on the mother board 14. The contact areas 34 are located at second ends of the contacts and are deflectable as the card edge connection area 30 of the daughter board 12 is inserted into the receiving area 26. The contact areas 34 are adapted to electrically contact contact pads 54 on the daughter printed circuit board 12.

In the embodiment shown, the connector 10 also includes through-hole mounts that are comprised of metal latches 56. The latches 56 are fixedly connected to the hosing and extend from the bottom of the housing. Each latch 56 has a pair of spring legs 58 that extend through holes of the mother board 14 to fixedly mount the connector 10 to the mother board. The shape of the ends of the legs 58 and spacing between latches 56 is designed to pull the housing 16 against the top surface of the mother board 14. One of the latches **56*a* is orientated differently than the other latches. This helps to assure proper and exact positioning of the connector 10 on the mother board 14. In the embodiment shown, the contact pads 52 and solder tails 50 are on center-to-center pitch or spacing of only about 0,050 inch and are about 0.02 and 0.03 inch wide. Therefore, proper and exact positioning is important to prevent misconnection. In alternate embodiments, other types of means to mount the housing 16 to the mother board 14** could be provided.

The daughter board 12, in the embodiment shown, is a SIMM printed circuit board. More specifically, it is a double sided SIMM with electric components 60 on both sides. The SIMM board 12 also has contact pads 54 on both sides at the card edge connection area 30. The open area between the two end supports 38 allows the electric components 60 to be located in that open area. Hence, the daughter board can be designed to a smaller size, but the end supports 38 nonetheless provide ample stability of the mounting of the daughter board 12 to the connector 10. Unlike prior double sided SIMM card edge connectors, the connector's 10 use of standoff outriggers 36 in the center section 20 and standoff outrigger bottoms 40 at the end sections 22, 24 make the mounting of the connector 10 on the mother board 14 very stable. This is particularly advantageous for the surface mounted connector 10 shown in FIGS. 1–4 where the solder tails 50 of the contacts 18 are merely surface mounted on the mother board 14. These standoff outriggers 36 prevent stress, being developed from movement of the daughter board 12 in the card receiving area 26, from reaching the solder joint at the solder tails 50 and contact pads 52. This makes the solder joint much more reliably. In alternate embodiments, additional standoffs and/or standoff outriggers could be provided. Use of the standoff outriggers provide ample stability for the surface mounted connector 10, but nonetheless minimizes the size of the housing 16 and the amount of real estate or area it occupies on the mother board 14. As shown with reference to FIG. 5, the same housing 16 can also be used with through-hole mounted contacts **18*a* in a connector 10*a***.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claim is

1. A card edge connector comprising:

a housing having a center section with a card edge receiving area, end supports located at opposite ends of the center section, and support outriggers, the end supports each extending up past a top surface of the center section and having a slot for receiving a portion of a printed circuit board, the outriggers extending laterally outward from longitudinal sides of the center section at a bottom of the housing; and electrical contacts mounted to the housing.

2. A connector as in claim 1 wherein the outriggers also extend down from the bottom of the center section to form standoffs for the housing.

3. A connector as in claim 1 wherein the slots in the end supports each have an open top end, an open inner side that faces the other slot, and remaining bottom end and sides that are closed.

4. A connector as in claim 1 wherein the electrical contacts have surface mount solder tails that extend from the bottom of the housing with an extended length to allow for increased deflection and stress absorption.

5. A connector as in claim 1 further comprising metal through-hole latches connected to the housing and extending from the bottom of the housing.

6. A connector as in claim 5 wherein each latch has a pair of spring legs with at least one latch having its pair of spring legs orientated differently than one of the other pairs of spring legs.

7. A connector as in claim 1 wherein the height of the housing is about 0.22 inch except at the end supports which has a height of about 0.61 inch.

8. A connector as in claim 7 wherein the depth of the card edge receiving area is about 0.175 inch.

9. A card edge connector comprising:

a one-piece molded dielectric housing having a center section and end sections located on opposite ends of the center section, the center section having a card edge receiving area and outriggers extending laterally outward from longitudinal sides of the center section at a bottom of the housing, the end sections each extending upward past a top surface of the center section to form an upwardly extending card support with a slot for receiving a portion of a daughter printed circuit board, the end sections also having outriggers extending laterally outward from the end sections; and electrical contacts mounted to the housing.

10. A connector as in claim 9 wherein the outriggers have bottom surfaces spaced from the rest of the housing to form standoffs for the housing when the connector is connected to a mother printed circuit board.

11. A connector as in claim 9 further comprising metal through from the bottom of the housing.

12. A connector as in claim 9 wherein the slots are enclosed except for an open top and an interior side, the slots being separate from the card edge receiving area.

13. A card edge connector and printed circuit board assembly comprising:

a mother printed circuit board;

a card edge connector connected to the mother board, the connector having a housing and a plurality of spring contacts, the housing having a center section with a card edge receiving area and two end sections with upwardly extending card end supports, a top surface of the center section being substantially shorter in height than the end sections, the end supports having card receiving slots, the housing having standoff outriggers spaced from the end sections that extend from the bottom of the center section downwardly and laterally outwardly to function as both standoffs and stability outriggers on a surface of the mother printed circuit board, the spring contacts having surface mounted solder tails extending out of the housing and surface mount connected to contact areas on the mother printed circuit board; and a daughter printed circuit board having a card edge connection area with contact pads on two sides located in the card edge receiving area and end edges located in and structurally supported by the card receiving slots of the end supports, wherein the height of the center section is relatively short, but the end sections assist in stably connecting the daughter board to the connector.

14. A connector as in claim 13 wherein the card receiving slots are substantially enclosed except for open interior sides and open top ends.

15. A connector as in claim 13 wherein the daughter board comprises a SIMM printed circuit board.

16. A connector as in claim 13 wherein the height of the center section is about 0.28 inch and the height of the end sections are about 0.61 inch.

17. An electrical connector comprising:

a housing having a receiving area, end supports located at opposite ends of the receiving area, and support outriggers, the outriggers extending outward from lateral sides of the housing at a bottom of the housing;

electrical contacts mounted to the housing; and metal through-hole latches connected to the housing and extending from the bottom of the housing, each latch

* * * * *

UNITED STATES PATENT AND TRADEMARK OFFICE

CERTIFICATE OF CORRECTION

PATENT NO. : 5,509,826

DATED : April 23, 1996

INVENTOR(S) : White

It is certified that error appears in the above-identified patent and that said Letters Patent is hereby corrected as shown below:

In column 4, line 49, after the word "through" insert -- -hole latches connected to the housing and extending--

In column 6, line 14, the end of the sentence, after the word "latch" should read —having a pair of spring legs with at least one latch having its pair of spring legs oriented differently than one of the other pairs of spring legs Signed and Sealed this Tenth Day of September, 1996

*Attest:*

*Attesting Officer*

Bruce Lehman

BRUCE LEHMAN

*Commissioner of Patents and Trademarks*

US005509826B1

REEXAMINATION CERTIFICATE (3462th)

United States Patent [19] [11] B1 5,509,826

White [45] Certificate Issued Mar. 10, 1998

[54] VERY LOW PROFILE CARD EDGE CONNECTOR

[75] Inventor: Robert C. White, Cliffside Park, N.J.

[73] Assignee: Burndy Corporation, Norwalk, Conn.

Reexamination Request:
No. 90/004,337, Aug. 22, 1996

Reexamination Certificate for:

| | |
|---|---|
| Patent No.: | **5,509,826** |
| Issued: | **Apr. 23, 1996** |
| Appl. No.: | **142,172** |
| Filed: | **Oct. 22, 1993** |

Certificate of Correction issued Sep. 10, 1996.

[51] Int. Cl.[6] ..... H01R 23/70
[52] U.S. Cl. ..... 439/637; 439/64
[58] Field of Search ..... 439/326–328, 439/377, 65, 68, 259, 260, 261, 267, 268, 350, 351, 352, 357, 358, 637, 64

[56] References Cited

U.S. PATENT DOCUMENTS

| | | |
|---|---|---|
| 4,915,636 | 4/1990 | Knight . |
| 5,024,609 | 6/1991 | Piorunneck . |
| 5,098,311 | 3/1992 | Roath et al. . |
| 5,419,712 | 5/1995 | Bellomo et al. . |
| 5,423,691 | 6/1995 | Pickles . |

*Primary Examiner*—J. J. Swann

[57] ABSTRACT

A card edge connector is provided with a housing and electrical contacts. The housing has a card edge receiving area, end supports located at opposite ends of the card edge receiving area, and stability outriggers. The end supports extend up from a top surface of the housing and each has a slot for receiving a portion of a printed circuit board. The outriggers extend outward from lateral sides of the housing at the bottom of the housing. The outriggers also function as standoffs for the housing.

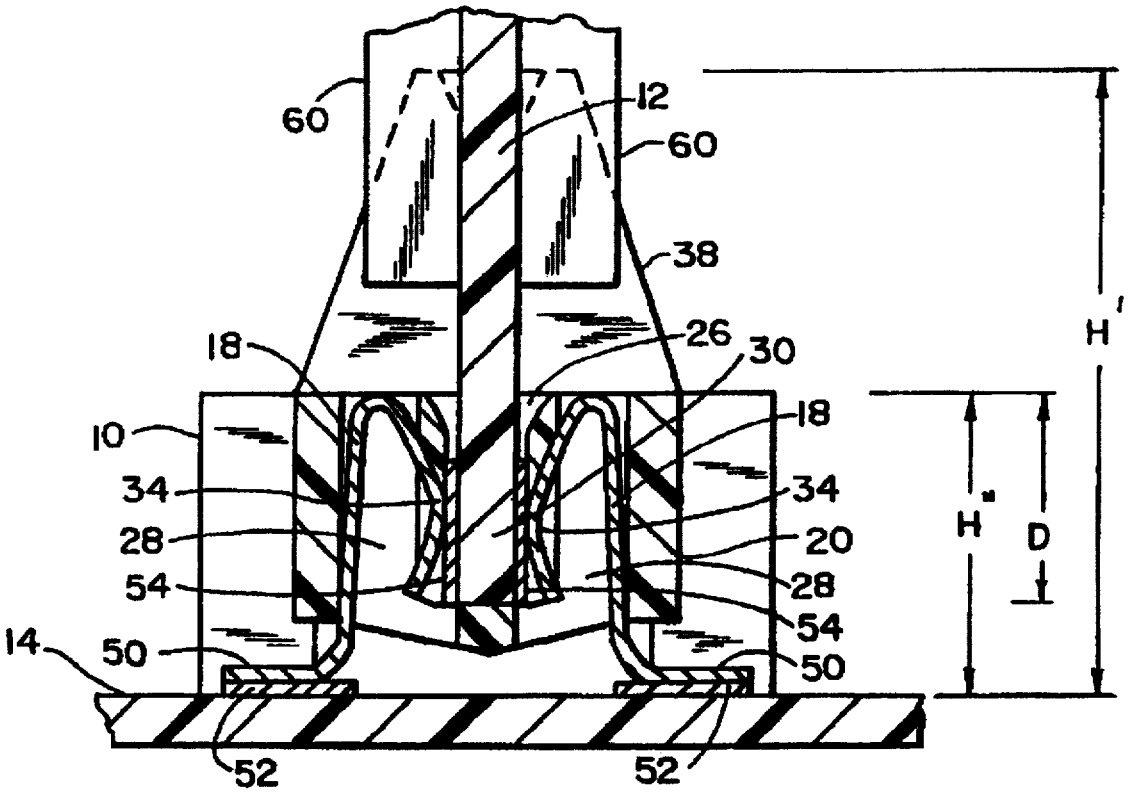

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–16 are cancelled.

Claim 17 is determined to be patentable as amended.

New claim 18 is added and determined to be patentable.

17. An electrical connector comprising:

a housing having a receiving area, end supports located at opposite ends of the receiving area, and support outriggers, the outriggers extending outward from two lateral sides of the housing *and from lateral sides of the end supports at a bottom of the housing, the outriggers further having bottom sides that are generally co-planar with one another* at a bottom of the housing;

electrical contacts mounted to the housing; and metal through-hole latches connected to the housing and extending from the bottom of the housing, each latch having a pair of spring legs with at least one latch having its pair of spring legs oriented differently than one of the other pairs of spring latches.

*18. A connector as in claim 17, wherein the lateral reach of the outriggers that extend from the lateral sides of the housing is equal to the lateral reach of the outriggers that extend from the end supports.*

* * * * *